United States Patent [19]

Cousins

[11] 4,368,786

[45] Jan. 18, 1983

[54] DOWNHOLE DRILLING APPARATUS

[76] Inventor: James E. Cousins, 1821 Bayou Dr., Shreveport, La. 71105

[21] Appl. No.: 250,160

[22] Filed: Apr. 2, 1981

[51] Int. Cl.[3] ..... E21B 4/04; E21B 4/18; E21B 17/046

[52] U.S. Cl. ..... 175/78; 175/61; 175/320; 464/19

[58] Field of Search ..... 175/52, 61, 78, 79; 166/55.2, 55.3; 64/2 R

[56] References Cited

U.S. PATENT DOCUMENTS

| | | | |
|---|---|---|---|
| 449,459 | 3/1891 | Addison | 175/78 X |
| 1,866,714 | 7/1932 | King | 64/2 R |
| 2,258,001 | 10/1941 | Chamberlain | 175/79 X |
| 2,500,785 | 3/1950 | Arutunoff | 175/78 |
| 2,539,047 | 1/1951 | Arutunoff | 175/78 X |
| 2,743,082 | 4/1956 | Zublin | 175/61 |
| 3,398,804 | 8/1968 | Holbert | 175/61 |
| 3,788,098 | 1/1974 | Miller et al. | 64/2 R |
| 3,993,127 | 11/1976 | Chepelev et al. | 175/61 X |
| 4,141,225 | 2/1979 | Varner | 175/57 X |
| 4,185,705 | 1/1980 | Bullard | 175/94 X |

*Primary Examiner*—Stephen J. Novosad

*Assistant Examiner*—George A. Suchfield

*Attorney, Agent, or Firm*—John M. Harrison

[57] ABSTRACT

A downhole drilling apparatus for drilling holes at right angles to a vertical well hole which includes a tubular housing capable of being inserted in the well hole and containing at least one elbow tube or guide, and multiple tapered and splined, interlocking drilling segments which are rotatably stacked and nested as a segment string in the guide tube with the bottom one of the drilling segments designed for drilling through the well casing, the concrete sheathing and into the production interval, and the top one of the segments cooperating with a drive means to effect rotation of the nested segments inside the guide. The guide tube extends from the tubular housing wall upwardly and telescopes at the top of the segment string to permit slidable movement of the drive means inside the tubular housing and slidable and rotatable movement of the nested segments inside the guide tube and into the production interval. In a preferred embodiment of the invention a pair of guide tubes and cooperating segment strings are provided in the tubular housing for drilling two transverse drain holes simultaneously.

19 Claims, 10 Drawing Figures

DOWNHOLE DRILLING APPARATUS

BACKGROUND OF THE INVENTION

1. Field of the Invention

This invention relates to the perforation of oil and gas wells to achieve maximum production of oil and gas, and more particularly, to a self-contained, downhole drilling apparatus for drilling production drain holes at right angles to a central well bore.

Production of hydrocarbons from oil and gas wells involves drilling a well bore to the producing interval and sealing a casing in the bore by pumping cement into the annular space between the bore and casing. Because of the varying porosity of the production intervals and other factors, it is necessary to provide lateral perforations or drain holes in the production interval for collection of the hydrocarbon fluid in the well bore. Conventional techniques for achieving this objective are frequently difficult to implement and the results sometimes defy accurate prediction.

The most basic and general benefit of a drain hole or drain holes in the production interval or zone of an oil or gas well is that of increasing the amount of formation surface exposed to the well bore. In addition to this desirable formation exposure, it has been found that there is a significant relationship between horizontal drain hole depth and an increase in bottom hole pressure. Productivity of a completed and perforated well depends upon the number of drain hole perforations in the production interval, the diameter and depth of penetration of the perforations, and the distribution of the drain hole perforations. Production in many wells has decreased over the years to the point of marginal profitability due to collapse of the drain hole walls, which reduces the flow of hydrocarbon fluid from the producing interval or "pay", into the well.

2. Description of the Prior Art

Conventional techniques for achieving production of hydrocarbons from the producing intervals of oil and gas wells include "perforating" the zone of production surrounding the well bore by means of perforating guns which are lowered into the well bore and fire projectiles through the well casing and concrete sheath, and into the production zone to create drain holes which allow hydrocarbons to flow from the production strata into the well bore. Other methods include the use of explosive, shaped charges which "jet" an aperture into the formation to create the desired hydrocarbon drainage. However, most of these devices do not have sufficient force to penetrate deep into the formation, and many times, the projectiles or explosive charges must penetrate two strings of casing, two cement sheaths and a wall of hard rock. Improved techniques which use equipment capable of achieving deeper projectile penetration and maximum backsurging to clean the drain holes are still capable of effecting only limited penetration into the production strata, even under ideal conditions. Other techniques include using chemical charges such as thermite which are ignited and create an extremely hot charge which burns through the casing, concrete and hydrocarbon-bearing zone. However, these devices are sometimes unreliable and are often not able to penetrate far enough into the "pay" zone to achieve a significant increase in hydrocarbon flow.

Other devices designed for lowering in the well for the purpose of boring and drilling holes at right angles to the well bore at the production interval, have been proposed, but many problems have been encountered in these systems. For example, the relatively low bit rotation speed generally necessitated by using a curved shaft sometimes requires too much time to achieve significant penetration, and increasing the bit rotational speed and shaft load frequently causes failure of the shaft. Generally, conventional drilling devices have not proved capable of sustaining the high compressive loads necessary to penetrate the well casing, concrete sheath, rock and producing interval within an economical time frame without failure. Other problems have been encountered with bit retrieval and freedom of rotation of the drilling string.

An early device for drilling drain holes transverse to the well bore is disclosed in U.S. Pat. No. 1,367,042 to B. Granville. This apparatus includes a rigid pipe fitted with an elbow; a flexible tube positioned inside the pipe and extending through the elbow; a drill bit rotatably mounted at the outer end of the flexible tube; and a flexible shaft attached to the drill bit and lying within the flexible tube. A drive mechanism is attached to the flexible shaft for driving the shaft and rotating the bit.

Other methods and mechanisms for achieving transverse drilling in a well bore are taught in U.S. Pat. No. 3,958,649 to George H. Bull, et al, which mechanisms include a flexible, spring biased, telescopic fluid conduit fitted with a turbodrill on the lower end designed to extend from an opening in the side of an elongated, cylindrical housing. The conduit further includes multiple, axially aligned spools with interconnecting cylinders and compression rings in the cylinders to create the desired flexibility and telescopic action.

Another downhole drilling system is disclosed in U.S. Pat. No. 4,051,908, to W. B. Driver, which system includes a 90 degree elbow attached to the downhole end of a tube section having a small diameter. The top of the tube section is attached to a tubing string of relatively large diameter, which houses a downhole electric motor. A small drill bit and flexible drill pipe operate in the small tube section to effect drilling into the production formation.

Yet another perforating tool for drilling transverse holes in oil and gas wells as disclosed in U.S. Pat. No. 4,185,705 to Gerald Bullard. This tool includes a housing for insertion in the casing and provided with a detachable boot. A pair of motors are used to rotate a flexible drill and to advance and retract the flexible drill shaft in order to effect penetration of the production formation with the drill.

It is an object of this invention to provide a downhole, transverse drilling apparatus which is self-contained and can be lowered into a well bore to drill one or more drain holes of selected depth into a producing interval to increase the flow of hydrocarbons from the interval into the well bore.

Another object of the invention is to provide a downhole drilling apparatus for drilling drain holes at right angles to a vertical well hole or bore, which apparatus can be lowered into the well bore by wire-line, stabilized in the bore, and activated to drill holes of selected size and depth in the hydrocarbon-producing strata.

Yet another object of the invention is to provide a self-contained, downhole, transverse drilling apparatus for drilling drain holes in oil and gas wells by penetrating beyond the "well skin" into undamaged production formation and increasing the flow of hydrocarbons into the well bore.

A still further object of this invention is to provide a self-contained, downhole drilling device which can be lowered into a well bore adjacent to a producing strata or interval and activated to bore through the well casing, concrete sheath and production interval to create one or more drain holes for enhancing the flow of hydrocarbons into the well bore, and particularly, for enhancing hydrocarbon production from characteristically slow-flowing formations such as chalk, clay and tight sands and aiding in artifically induced secondary and tertiary hydrocarbon recovery systems such as water and fire floods.

Yet another object of the invention is to provide a transverse, downhole drilling system which is self-contained in a tubular housing and includes a drilling string or strings characterized by multiple tapered, splined segments which nest and interlock inside one or more telescoping guide tubes in such a manner as to permit sufficient lateral movement to traverse the 90 degree bend in the guide tubes, with a drill bit on the lower end of the string and a gear-engaging means on the top end for engagement with a drive system and effecting rotation of the string and drill bit.

SUMMARY OF THE INVENTION

These and other objects of the invention are provided in a downhole, transverse drilling apparatus which is characterized by a tubular housing containing at least one telescoping guide tube having a relatively large radius, 90 degree elbow and at least one drill string in the guide tube and formed by multiple tapered, splined drill string segments which interlock and nest and are driven by a self-contained drive mechanism to force a drill bit attached to the lowest of the segments and the accompanying drill string through the well casing, concrete sheath and into the production formation. According to a preferred embodiment of the invention the string of segments is removed from the drilled drain hole or holes by means of a cable running through the center of the segments, and the bit may be left in the drain hole.

BRIEF DESCRIPTION OF THE DRAWINGS

This invention will be better understood by reference to the accompanying drawings, wherein.

DESCRIPTION OF THE PREFERRED EMBODIMENTS

Figure 1:
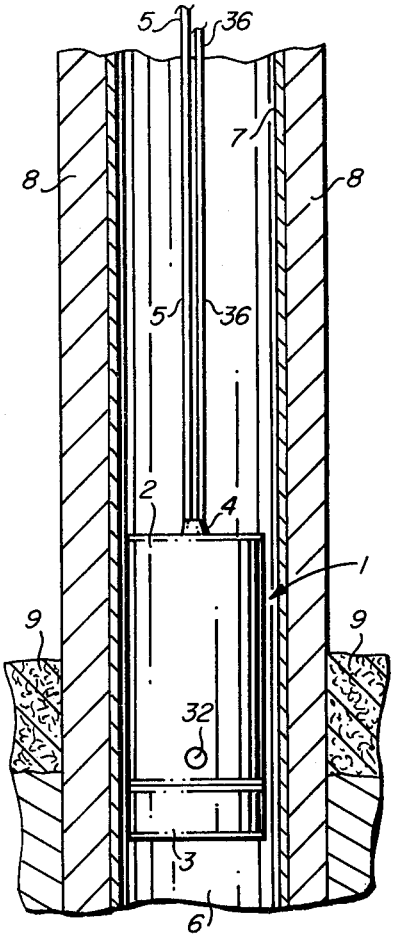
FIG. 1 is an elevation of the downhole drilling apparatus of this invention positioned in a well bore.

Referring now to FIG. 1 of the drawings the downhole drilling apparatus of this invention is generally illustrated by reference numeral 1, and includes a generally cylindrically shaped housing 2, having a stabilizer or packer 3, mounted on the bottom thereof. A wire line mount 4 is provided on the top of housing 2, and is attached to a wireline cable 5, which includes a conventional wire line and suitable electric wiring for energizing a downhole motor located in housing 2, as hereinafter described. A drive housing cable 36 extends through wireline mount 4 and housing 2, and is attached to the drive housing of downhole drilling apparatus 1, as hereinafter described. Downhole drilling apparatus 1 is suspended in the well bore 6 of an oil or gas well to a point adjacent a zone of hydrocarbon production or interval 9 by means of wire line cable 5. Casing 7 is mounted in the well in conventional fashion by means of a cement sheath 8, as illustrated, and the diameter of housing 2 is slightly smaller than the inside diameter of casing 7 to permit downhole drilling apparatus 1 to be raised and lowered inside casing 7 in order to position the apparatus in alignment with the hydrocarbon-producing interval 9. The depth of the producing interval 9 is determined by conventional well logging techniques well known to those skilled in the art.

Figure 2:
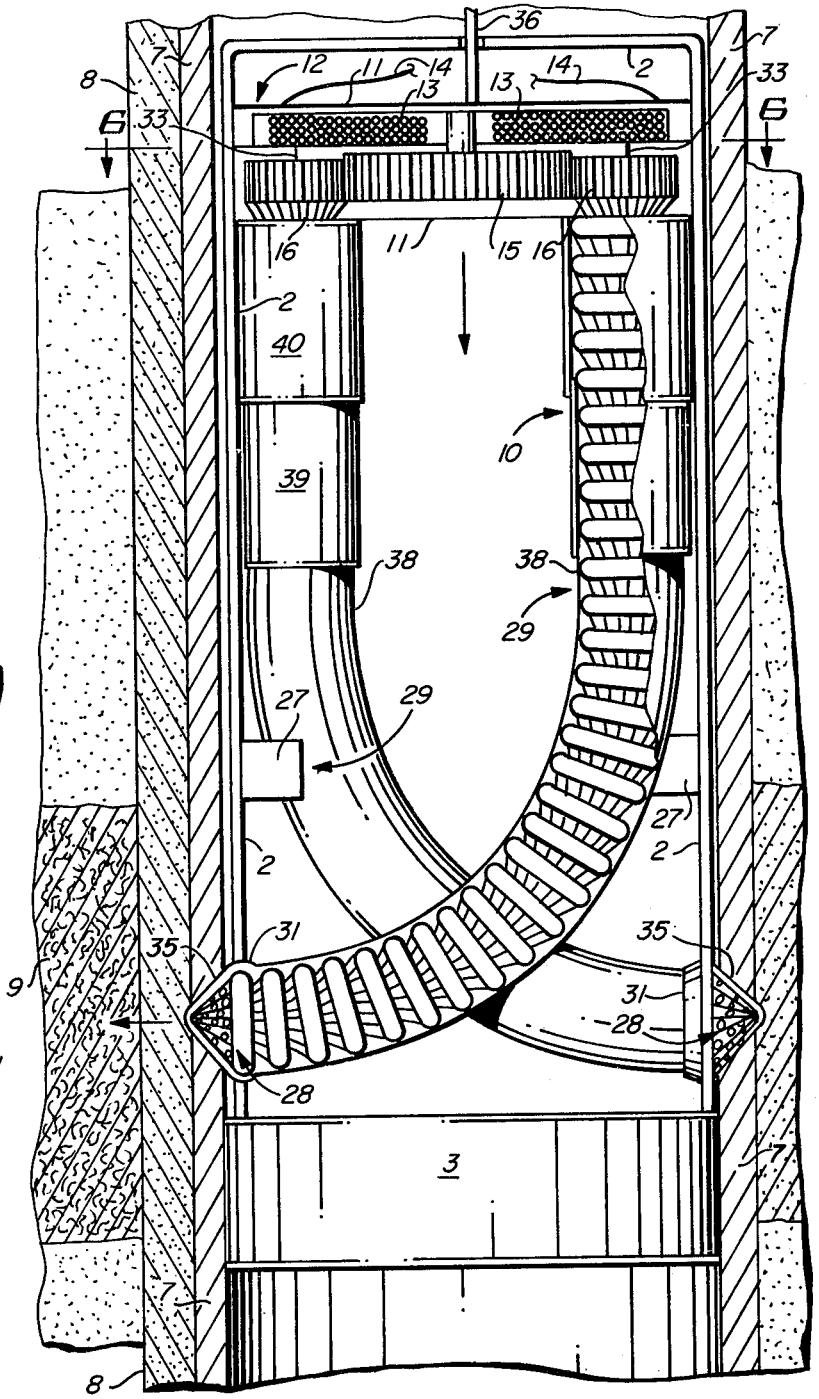
FIG. 2 is a front elevation, partially in section, of the downhole drilling apparatus illustrated in FIG. 1, more particularly illustrating the drill strings and guide tubes.

Referring now to FIGS. 1 and 2, and specfically to FIG. 2, the downhole drilling apparatus 1 is illustrated partially in section, and includes a pair of curved guide tubes 29, each having a bottom end 31 secured to the lower end of housing 2, and blocked by a thin plug 32, in housing 2, as shown in FIG. 1. The guide tubes 29 curve upwardly from each plug 32 in opposite directions to define a 90 degree bend across the inside diameter of housing 2 and terminate in upward extending, opposed relationship at top end 38. A lower guide sleeve 39 concentrically and slidably overlaps top end 38 and is slidably and concentrically attached to an upper guide sleeve 40, which is in turn attached to the bottom of drive housing 11. An upper guide sleeve lock 41, illustrated in FIG. 7, serves to stabilize lower guide sleeve 39 in upper guide sleeve 40. This mechanical arrangement facilitates telescoping of upper guide sleeve 40 on lower guide sleeve 39, and lower guide sleeve 39 on top end 38 of guide tube 29, as drive housing 11 descends in housing 2. Drive housing 11 is free to slide up and down inside housing 2, and is maintained in the top of housing 2 prior to drilling, by a drill string 10, positioned in each one of guide tubes 29. Guide tubes 29 are stabilized inside housing 2 by means of guide braces 27, as illustrated in FIG. 2.

Figure 3:
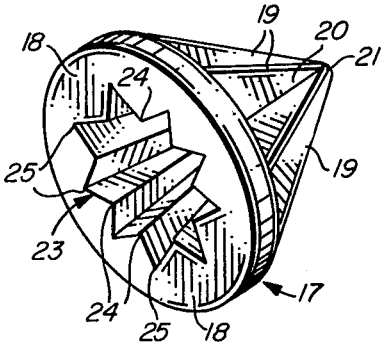
FIG. 3 is a perspective view of a drill string segment.
Figure 4:
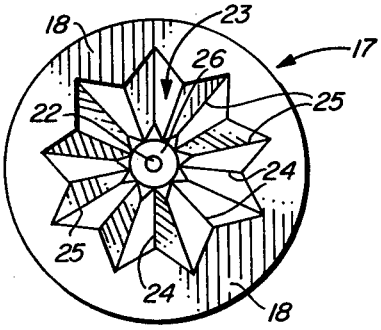
FIG. 4 is a bottom elevation of the drill string segment illustrated in FIG. 3.
Figure 5:
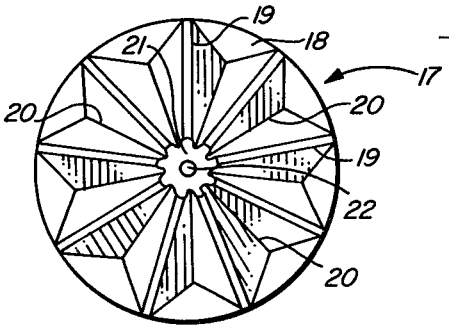
FIG. 5 is a top elevation of the drill string segment illustrated in FIGS. 3 and 4.

Referring now to FIGS. 2–5, each drill string 10 is formed by stacking multiple drill string segments 17 in guide tubes 29, each of which segments include a flat segment head 18 and longitudinally tapering, exterior splines 19, as specifically illustrated in FIGS. 3–5. In a preferred embodiment of the invention each one of drill string segments 17 is shaped to include nine exterior splines 19, which in turn taper in a direction transverse to the longitudinal axis of the splines to define exterior spline slots 20, in a repetitive, geometric pattern to resemble a nine-point star when viewed from the bottom, as illustrated in FIG. 4. The longitudinal taper of exterior splines 19 extends from the bottom surface of segment head 18 to a flat tip 21, having a tip aperture 22 in the center thereof and extending through tip 21 into the hollow segment interior 23 of drill string segments 17, as illustrated in FIGS. 3 and 5. Referring again to FIGS. 3 and 5, the segment interior 23 of drill string segments 17 is designed to register with the exterior surfaces of the drill segments, and includes multiple, spaced interior splines 24, which project into segment interior 23, and correspond to exterior spline slots 20. Interior splines 24 extend from the surface of segment head 18 to tip seat 26, which corresponds to tip 21. Interior splines 24 also taper transversely to the longitudinal axis of the splines to define interior spline slots 25, the latter of which corresponds to exterior splines 19. Accordingly, drill string segments 17 will nest, stack and interlock to shape each drill string 10, as illustrated in FIG. 2, with the exterior splines 19 of one segment registering with the interior spline slots 25 of an adjacent segment, and corresponding registration of interior splines 24 of the first segment with exterior spline slots 20 of the second segment. This interlocking registration is not rigid, but permits lateral movement of the drill string segments 17 in the interlocking and nested configuration, such that the segments can easily bend to conform to the elbow bend in guide tubes 29, and yet maintain an interlocking relationship. This lateral movement of drill string segments 17 in the registered and stacked configuration allows torque to be applied to the top of each drill string 10 to rotate the drill strings inside guide tubes 29 and drive a pair of segment drill bits 28, for boring through casing 7, cement 8, and into producing interval 9, as illustrated in FIG. 2. In a most preferred embodiment of the invention the angle of taper of exterior splines 19 from segment head 18 to tip 21 is about 30 degrees with respect to the vertical when one of drill string segments 17 is viewed with the segment head 18 upwardly. Furthermore, when the drill segment 17 is viewed in this spatial orientation the angle of taper of exterior spline slots 20 and corresponding interior splines 24 from segment head 18 to tip 21 is about 10 degrees. The structuring of drill segments 17 facilitates a drill string 10 which is capable of bending about ¼ of an inch for each one of drill segments 17 used, in order to facilitate traversal of the bend in guide tubes 29 and yet maintain sufficient interlocking contact to effect rotation of segment bits 28.

Figure 6:
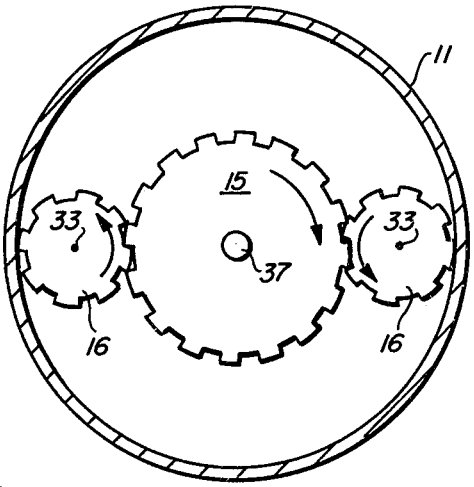
FIG. 6 is a sectional view, taken along lines 6—6 in FIG. 2, more particularly illustrating a preferred gear drive for driving the drill string.

Referring now to FIGS. 2 and 6, in a preferred embodiment of the invention drive housing 11 contains a drive motor 12, having motor windings 13 and appropriate wiring 14 in electrical cooperation with the wiring in wire line cable 5 to energize drive motor 12. Drive motor 12 carries a drive shaft 37 and a drive gear 15, which rotatably cooperates with drill string gears 16, as is more particularly illustrated in FIG. 6. The bottom sections of drill string gears 16 are tapered and shaped to define exterior splines 19, exterior spline slots 20, and tips 21 to register with the interior spline slots 25 and interior splines 24, respectively, of the top ones of drill string segments 17 in each drill string 10, as illustrated in FIG. 2. Furthermore, the segment interior 23 of each segment bit 28 is also provided with interior splines 24 and interior spline slots 25, for interlocking and nesting with the exterior spline slots 20 and exterior splines 19, respectively, of the last one of drill string segments 17 in each drill string 10, to effect rotation of segment bit 28.

Figure 7:
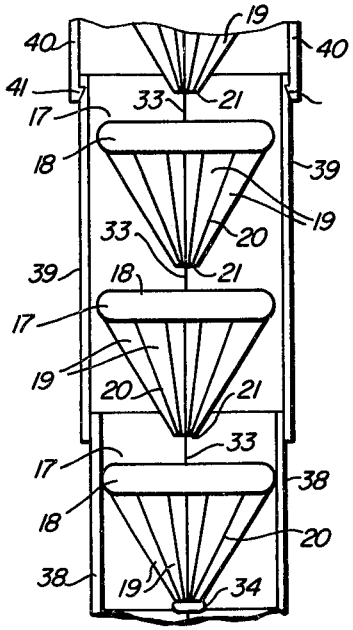
FIG. 7 is a sectional view of the telescoping segment of the guide tube, illustrating mounting of the drill string segments on a cable for retrieval.
Figure 8:
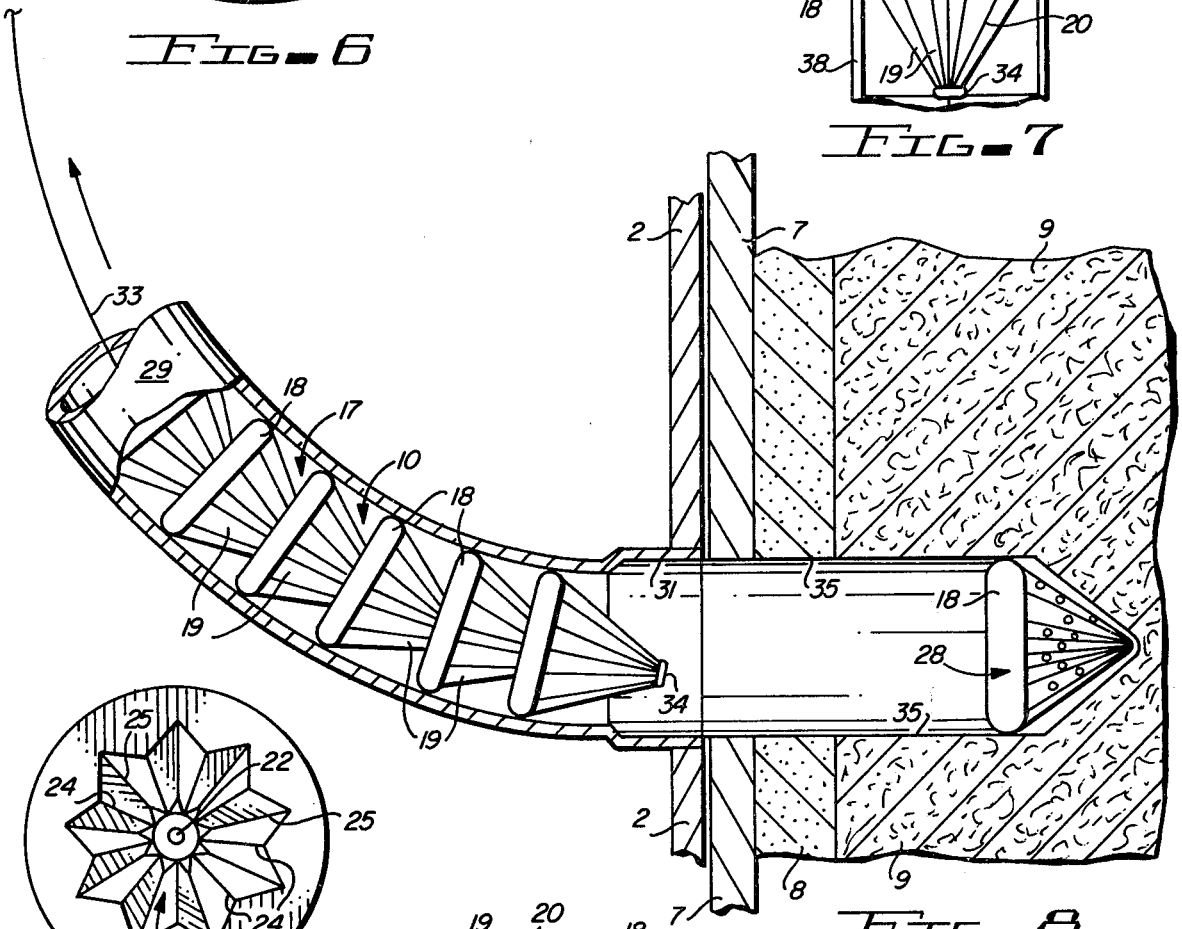
FIG. 8 is a sectional view of the apparatus housing and the lower segment of a guide tube, more particularly showing one string of the drill string segments retrieved from a drain hole drilled in the production interval.

Referring now to FIGS. 7 and 8 of the drawings, in another preferred embodiment of the invention the drill string segments 17 are provided with a segment cable 33, one end of which is fitted with a cable stay 34, and the other end threaded through the tip aperture 22 of the last one of drill string segments 17 in each drill string 10, and then through the tip aperture 22 of each of the nested drill string segments 17, for attachment to drive housing 11. In this manner one or more drain holes 35 can be drilled according to the procedure hereinafter outlined, and each drill string 10 can be retrieved from the drain hole 35 by application of segment cable 33, as illustrated in FIG. 8. In a most preferred embodiment of the invention each one of segment bits 28 is about 15 to about 20 percent larger than the drill string segments 17, to better facilitate retrieval of the drill string 10, and is left in the drain hole after the drilling operation has been completed, as hereinafter described. Furthermore, in this embodiment of the invention, bottom end 31 of guide tubes 29 is flared or enlarged, as illustrated in FIGS. 2 and 8, to accommodate the enlarged segment bit 28.

In operation, and referring again to the drawings, a downhole drilling apparatus 1 of appropriate size to fit inside the casing 7 of a well is attached to a wire line cable 5 and is lowered into the well bore casing 7 to a desired predetermined point adjacent a hydrocarbon-producing interval 9, as illustrated in FIG. 1. The packer 3 is then activated to secure downhole drilling apparatus 1 in casing 7, and drive motor 12 is energized. This action causes drill strings 10 to rotate in guide tubes 29 through the action of drive gear 15 and drill string gears 16 and the interlocking and nesting relationship between successive drill string segments 17. As segment bits 28 rotate, the bits bore initially through each plug 32 in the bottom ends 31 of guide tubes 29, and then through casing 7 and cement 8, and finally drill into the producing interval 9, as illustrated in FIG. 2. The advancement of segment bits 28 and drill strings 10 through producing interval 9 to create drain holes 35 is effected by the telescoping action of lower guide sleeve 29 and upper guide sleeve 40, and by the weight of drive housing 11, which bears on drill strings 10 and applies sufficient pressure on the nested drill string segments 17 to cause segment bits 28 to bore through the surrounding strata. It will be appreciated that under circumstances where the weight of the drive housing 11 is insufficient to load the drill strings 10 to the extent that segment bits 28 will readily bore through the casing 7, concrete 8 and producing interval 9, additional weight can be added to drive housing 11, as desired, by raising the down hole drilling apparatus 1. This weight can be added in the form of round plates which are shaped to fit inside housing 2 and rest on the top drive housing 11. When it is desired to remove the drill strings 10 from the drain holes 35, tension is applied to drive housing cable 36 to raise drive housing 11 and remove the drill strings 10 from drain holes 35 by the action of segment cables 33, leaving segment bits 28 in drain holes 35, respectively, as illustrated in FIG. 2.

Figure 9:
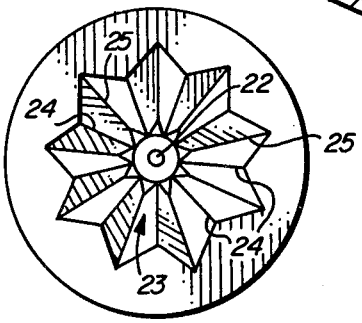
FIG. 9 is a top view of a most preferred drill string segment.
Figure 10:
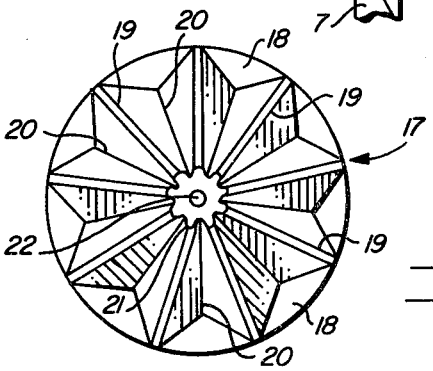
FIG. 10 is a bottom view of the drill string segment illustrated in FIG. 9.

Referring now to FIGS. 9 and 10, in a most preferred embodiment of the invention the taper of exterior splines 19 in transverse relationship to the longitudinal axis of the splines in uneven, with the right-hand clockwise taper being smaller in surface area than the left when each drill string segment 7 in question is viewed from the bottom, as illustrated in FIG. 10. It has surprisingly been found that when the drill string segments 17 are so designed, a counter-clockwise rotation of the drill strings 10 is much smoother than is the case under circumstances where the exterior splines 19 of drill string segments 17 are uniformly shaped and uniformly transversely tapered, as illustrated in FIGS. 3–5. Conversely, if the drill strings 10 are to be driven in the clockwise direction by a counterclockwise rotation of drive gear 15, then the taper of exterior splines 19 should be reversed from the configuration illustrated in FIG. 10. As illustrated in FIG. 9, the transverse taper of interior splines 24 is also offset in the same manner as that of the exterior splines 19, to match the taper of exterior spline slots 20, in order to insure proper registration and stacking of the drill string segments 17.

It will be further appreciated by those skilled in the art that substantially any number of exterior splines 19, exterior spline slots 20, interior splines 24 and interior spline slots 25 can be provided in the design of drill string segments 17. However, in a preferred embodiment of the invention nine exterior splines 19, exterior spline slots 20, and matching interior splines 24 and interior spline slots 25 are provided for each one of drill string segments 17, as illustrated in FIGS. 3–5. In a most preferred embodiment, the nine exterior splines 19 and interior splines 24 are unequally tapered for optimum smoothness of rotation of drill string segments 17, as illustrated in FIGS. 9 and 10.

It will be appreciated by those skilled in the art that the downhole drilling apparatus of this invention can be sized such that the housing 2 will slidably fit substantially any well casing. For example, under circumstances where the casing inside diameter is 4.09 inches, the diameter of housing 2 can be about 3.9 inches. Under these circumstances the radius of curvature of guide tubes 29 should be about 3.8 inches to facilitate a smooth curvature in which to stack drill string segments 17. Under circumstances where the casing inside diameter is 5.012 inches, a downhole drilling apparatus housing outside diameter of about 4.9 inches can be used, with guide tubes 29 having a radius of curvature equal to about 4.8 inches. Furthermore, the guide tubes 29 and drill string segments 17, as well as the segment bits 28, can be manufactured to selected specifications, depending upon the size of the housing 2 and the desired size of the drain holes 35.

While additional guide tubes 29 can be installed in housing 2, in a most preferred embodiment of the invention two such guide tubes are preferred for simplicity of operation and to reduce the amount of weight necessary for application to drill strings 10 in order to achieve efficient cutting by segment bits 28. It will, however, be appreciated by those skilled in the art that a single drill string 10 and guide tube 29 can be used, as desired.

It will be further appreciated by those skilled in the art that the downhole drilling apparatus of this invention can be used in substantially any application where a transverse, off-set hole must be drilled from a primary bore. Accordingly, the apparatus is not limited to use in drilling drain holes in oil and gas wells, but may also be used in such applications as conduit installation and other applications where transverse off-shoot tunnels are necessary from primary borings.

Having described my invention with the particularity set forth above, what is claimed is:

1. A downhole drilling apparatus for boring holes in a production interval of an oil or gas well comprising:

(a) a tubular housing having a diameter of sufficient size to fit in said well;

(b) at least one guide tube having one end attached to the wall of said housing and the opposite end curving upward to define a 90 degree arc, and terminating at a point opposite and above said one end;

(c) a plurality of drilling segments positioned in said at least one guide tube, each of said segments having a round head and multiple, exterior splines and exterior spline slots tapering in spaced relationship from said head to a tip, and further comprising multiple interior splines and interior spline slots for registering with said exterior splines and said exterior spline slots, respectively, of adjacent ones of said drilling segments, and interlocking said drilling segments in stacked relationship to form a drill string in said at least one guide tube;

(d) drill bit means cooperating with the bottom one of said drilling segments in said drill string; and (e) drive means slidably mounted in said tubular housing and cooperating with the top one of said drilling segments and resting on said drill string to effect rotation of said drill string and boring of said drill bit means and said drill string into said production interval of said well responsive to slidable descent of said drive means in said tubular housing.

2. The downhole drilling apparatus of claim 1 wherein said at least one guide tube is a pair of guide tubes in oppositely disposed relationship in said tubular housing.

3. The downhole drilling apparatus of claim 1 wherein said drive means further comprises a drive housing slidably fitted inside said tubular housing and containing a drive motor and a drive gear rotatably driven by said drive motor, and further comprising at least one drill string gear mounted on said top one of said drilling segments and meshing with said drive gear to effect rotation of said drill string and said drill bit means when said drive motor is energized.

4. The downhole drilling apparatus of claim 1 wherein:

(a) said at least one guide tube is a pair of guide tubes in oppositely disposed relationship in said tubular housing; and (b) said drive means further comprises a drive housing slidably fitted inside said tubular housing and containing a drive motor and a drive gear rotatably driven by said drive motor, and further comprising a drill string gear mounted on said top one of said drilling segments in each of said guide tubes and meshing with said drive gear to effect rotation of said drill string and said drill bit means when said drive motor is energized.

5. The downhole drilling apparatus of claim 1 further comprising a packer attached to the lower end of said tubular housing for engaging the walls of said well bore and stabilizing said apparatus in said well bore.

6. The downhole drilling apparatus of claim 1 further comprising a packer attached to the lower end of said tubular housing for engaging the walls of said well bore and stabilizing said apparatus in said well bore; and wherein:

(a) said at least one guide tube is a pair of guide tubes in oppositely disposed relationship in said tubular housing; and (b) said drive means further comprises a drive housing slidably fitted inside said tubular housing and containing a drive motor and a drive gear rotatably driven by said drive motor, and further comprising a drill string gear mounted on said top one of said drilling segments in each of said guide tubes and meshing with said drive gear to effect rotation of said drill string and said drill bit means when said drive motor is energized.

7. The downhole drilling apparatus of claim 1 wherein said multiple exterior splines and exterior spline slots is nine exterior splines and exterior spline slots in spaced, alternating relationship on the exterior surface of said drilling segments, and said multiple interior splines and interior spline slots is nine interior splines and interior spline slots in spaced, alternating relationship in the hollow interior of said drilling segments.

8. The downhole drilling apparatus of claim 1 further comprising a packer attached to the lower end of said tubular housing for engaging the walls of said well bore and stabilizing said apparatus in said well bore; and wherein:

(a) said at least one guide tube is a pair of guide tubes in oppositely disposed relationship in said tubular housing;

(b) said drive means further comprises a drive housing slidably fitted inside said tubular housing and containing a drive motor and a drive gear rotatably driven by said drive motor, and further comprising a drill string gear mounted on said top one of said drilling segments in each of said guide tubes and meshing with said drive gear to effect rotation of said drill string and said drill bit means when said drive motor is energized; and (c) said multiple exterior splines and exterior spline slots is nine exterior splines and exterior spline slots in spaced, alternating relationship on the exterior surface of said drilling segments, and said multiple interior splines and interior spline slots is nine interior splines and interior spline slots in spaced, alternating relationship in the hollow interior of said drilling segments.

9. The downhole drilling apparatus of claim 8 wherein said exterior splines and said interior splines are provided with an unequal taper transverse to the axis of said splines, and said unequal taper is uniform on corresponding faces of said exterior splines and said interior splines.

10. The downhole drilling apparatus of claim 8 further comprising a pair of telescoping sleeves each having one end slidably carried by said opposite end of one of said guide tubes and the opposite end of said telescoping sleeves attached to said drive housing for supporting the upper end of said drill string and telescoping responsive to descent of said drive housing in said tubular housing.

11. The downhole drilling apparatus of claim 1 or 9 or 10 further comprising a segment cable extending from said drive means through said drilling segments and attached to said bottom one of said drilling segments whereby said drill string is retrieved from said holes after said boring is completed responsive to upward movement of said drive means in said tubular housing.

12. The dowhole drilling apparatus of claim 1 further comprising telescoping sleeve means cooperating with said opposite end of said at least one guide tube and attached to said drive means for supporting the upper end of said drill string and telescoping responsive to descent of said drive means in said tubular housing.

13. A downhole drilling apparatus for drilling drain holes in a production interval at essentially right angles to the well bore of an oil or gas well comprising:

(a) a generally cylindrically-shaped housing for insertion in said well bore;

(b) a pair of curved, hollow guide tubes having one end attached to opposite interior sides of said tubular housing and extending upwardly in crossed relationship and spanning the width of said tubular housing, with the opposite end of each of said guide tubes terminating in upward-standing position;

(c) a plurality of drilling segments arranged in stacked and nested relationship in each of said guide tubes to shape a pair of flexible drill strings, said drilling segments each characterized by a round head and multiple exterior splines and alternating exterior spline slots tapering in spaced relationship from the periphery of said head to a tip, and further including a hollow interior shaped to define multiple interior splines corresponding to said exterior spline slots, and interior spline slots corresponding to said exterior splines, to facilitate registration of said exterior splines and exterior spline slots of one of said drilling segments with said interior spline slots and said interior splines of an adjacent one of said drilling segments, respectively, and nesting of said drilling segments to form said drill strings;

(d) A drill bit having a drilling surface and multiple interior splines and interior spline slots for registering with the exterior spline slots and exterior splines, respectively, of the bottom ones of said drilling segments in said drill strings;

(e) a drive housing slidably positioned in the upper end of said tubular housing;

(f) a segment cable extending from said drive housing through said hollow interior of said drilling segments in each of said drill strings and attached to said bottom ones of said drilling segments whereby said drill strings are retrieved from said drain holes responsive to upward movement of said drive housing;

(g) a drive motor mounted in said drive housing and provided with wiring for energizing said drive motor from the surface of said well, and a drive gear rotatably driven by said drive motor; and (h) a pair of drill string gears carried by the top ones of said drilling segments in said drill strings and cooperating with said drive gear to effect rotation of said drill strings and said drill bit when said drive motor is energized.

14. The downhole drilling apparatus of claim 13 wherein said exterior splines and said interior splines on said drilling segments, and said interior splines on said drill bit are provided with an unequal taper transverse to the axis of said splines, and said unequal taper is uniform on corresponding faces of said exterior splines and said interior splines.

15. The downhole drilling apparatus of claim 13 further comprising telescoping sleeves, each having one end slidably attached to said opposite end of one of said guide tubes and the opposite ends of said sleeves attached to said drive housing for supporting the upper end of said drill strings and telescoping responsive to descent of said drive housing in said tubular housing.

16. The downhole drilling apparatus of claim 13 further comprising telescoping sleeves each having one end slidably attached to said opposite end of one of said guide tubes and the opposite ends of said sleeves attached to said drive housing for supporting the upper end of said drill strings and telescoping responsive to descent of said drive housing in said tubular housing, and wherein said exterior splines and said interior splines on said drilling segments and said interior splines in said drill bit are provided with an unequal taper transverse to the axis of said splines, and said unequal taper is uniform on corresponding faces of said exterior splines and said interior splines.

17. The downhole drilling apparatus of claim 13 wherein a first angle of taper of said exterior splines from said head to said tip is about 30 degrees, and a second angle of taper of said interior splines from said head to said tip is about 10 degrees.

18. The downhole drilling apparatus of claim 13 further comprising telescoping sleeves, each having one end slidably attached to said opposite end of one of said guide tubes and the opposite ends of said sleeves attached to said drive housing for supporting the upper end of said drill string and telescoping responsive to the descent of said drive housing in said tubular housing, and wherein:

(a) said exterior splines and said interior splines on said drilling segments, and said interior splines on said drill bit are provided with an unequal taper transverse to the axis of said splines, and said unequal taper is uniform on corresponding faces of said exterior splines and said interior splines; and (b) a first angle of taper of said exterior splines from said head to said tip is about 30 degrees, and a second angle of taper of said interior splines from said head to said tip is about 10 degrees.

19. The downhole drilling apparatus of claims 13 or 18 further comprising an enlargement in said one end of said guide tubes and wherein said drill bit is larger in diameter than said drilling segments and normally registers with said enlargement in said one end of said guide tubes prior to drilling said drain holes.

* * * * *